US009970425B2

(12) United States Patent
Cimatti

(10) Patent No.: US 9,970,425 B2
(45) Date of Patent: May 15, 2018

(54) INTERNAL COMBUSTION ENGINE PROVIDED WITH A COOLING PUMP THAT CAN BE MECHANICALLY DISCONNECTED

(71) Applicant: Ferrari S.p.A., Modena (IT)

(72) Inventor: Franco Cimatti, Pavullo (IT)

(73) Assignee: Ferrari S.p.A., Modena (IT)

( * ) Notice: Subject to any disclaimer, the term of this patent is extended or adjusted under 35 U.S.C. 154(b) by 402 days.

(21) Appl. No.: 14/268,103

(22) Filed: May 2, 2014

(65) Prior Publication Data

US 2014/0328703 A1 Nov. 6, 2014

(30) Foreign Application Priority Data

May 3, 2013 (IT) ..... BO2013A0195

(51) Int. Cl.

| | |
|---|---|
| ***F04B 35/00*** | (2006.01) |
| ***F01P 5/12*** | (2006.01) |
| ***F01P 7/16*** | (2006.01) |
| ***F04D 13/02*** | (2006.01) |
| ***F04D 1/00*** | (2006.01) |
| *F04D 29/049* | (2006.01) |
| *F04D 29/12* | (2006.01) |

(52) U.S. Cl.

CPC ..... *F04B 35/002* (2013.01); *F01P 5/12* (2013.01); *F01P 7/162* (2013.01); *F04D 1/00* (2013.01); *F04D 13/021* (2013.01); *F04D 29/049* (2013.01); *F04D 29/126* (2013.01)

(58) Field of Classification Search

CPC ..... F04B 35/002; F04D 1/00; F04D 13/021; F04D 29/049; F04D 29/126; F01P 7/162; F01P 5/12; F16D 11/02; F16D 2011/002; F16D 11/10

USPC ..... 417/319; 277/408, 457; 123/41.47, 123/198 C; 192/66.3, 66.31, 69.8

See application file for complete search history.

(56) References Cited

U.S. PATENT DOCUMENTS

| | | | | |
|---|---|---|---|---|
| 1,665,765 A | | 4/1928 | Barton | |
| 2,970,021 A | * | 1/1961 | Glaser | F16J 9/20 277/436 |
| 4,269,293 A | * | 5/1981 | Martin | F02B 67/04 192/12 D |
| 4,756,280 A | * | 7/1988 | Tamba | F01P 5/10 123/196 W |

(Continued)

FOREIGN PATENT DOCUMENTS

| | | |
|---|---|---|
| DE | 10 2006 032 793 A1 | 1/2008 |
| EP | 1149994 A2 | 10/2001 |

(Continued)

*Primary Examiner* — Dominick L Plakkoottam
*Assistant Examiner* — Philip Stimpert
(74) *Attorney, Agent, or Firm* — Blank Rome LLP

(57) ABSTRACT

An internal combustion engine having: an engine provided with a crankshaft; a cooling system provided with a circulation pump, which comprises an impeller supported by a pump shaft that is mounted so as to rotate around a rotation axis; an auxiliary shaft, which transmits the rotation movement to the pump shaft of the circulation pump; a mechanical transmission, which transmits the rotational movement from the crankshaft to the auxiliary shaft; and a coupling device, which is interposed between the pump shaft of the circulation pump and the auxiliary shaft and is suited to mechanically connect/disconnect the pump shaft to/from the auxiliary shaft.

24 Claims, 7 Drawing Sheets

(56) References Cited

U.S. PATENT DOCUMENTS

| | | | | |
|---|---|---|---|---|
| 5,482,432 | A | 1/1996 | Paliwoda et al. | |
| RE37,798 | E * | 7/2002 | Uchiyama | F01L 1/02 123/90.27 |
| 2002/0174840 | A1 * | 11/2002 | Luckner | F01P 7/165 123/41.1 |
| 2005/0028756 | A1 * | 2/2005 | Santanam | F01P 7/165 123/41.1 |
| 2007/0221464 | A1 * | 9/2007 | Liu | F16D 11/10 192/69.7 |
| 2009/0064962 | A1 * | 3/2009 | Ohsawa | F16F 15/267 123/192.2 |

FOREIGN PATENT DOCUMENTS

| | | | |
|---|---|---|---|
| JP | 2003-27942 | A | 1/2003 |
| WO | WO 2005/028901 | A1 | 3/2005 |

* cited by examiner

INTERNAL COMBUSTION ENGINE PROVIDED WITH A COOLING PUMP THAT CAN BE MECHANICALLY DISCONNECTED

BACKGROUND OF THE INVENTION

1. Field of the Invention

The present invention relates to an internal combustion engine provided with a cooling pump that can be mechanically disconnected.

2. Description of the Related Art

Modern internal combustion engines nearly always comprise a liquid cooling system in which a circulation pump circulates coolant (typically water mixed with an antifreeze substance) along a cooling path which extends in part within the internal combustion engine to remove the heat in excess and in part within a radiator to surrender the heat in excess coming from the internal combustion engine into the external environment.

In most vehicles, the circulation pump is directly fed so as to be rotated by the crankshaft by the interposition of a mechanical belt or chain transmission (more rarely by means of gears).

When the internal combustion engine is started after a long stop (i.e. one sufficiently long to take the temperature of the internal combustion engine to ambient temperature levels), it would be appropriate not to cool the internal combustion engine in order to promote a rapid reaching of the optimal working temperature; indeed, only when the internal combustion engine is at the optimal working temperature can the maximum energy efficiency and the minimum generation of polluting substances (i.e. maximum ecological efficiency) be achieved. For this purpose, modern internal combustion engines are normally provided with a thermostat valve which bypasses the part of the cooling system dedicated to dispersing the heat into the environment (i.e. the radiator) so that the coolant does not surrender heat into the external environment until the coolant itself reaches a sufficiently high temperature (i.e. reaches the optimal working temperature).

However, when the internal combustion engine is cold (i.e. colder than the optimal working temperature), the circulation pump of the cooling system continues to work by unnecessarily drawing mechanical power from the crankshaft (and thus dissipating mechanical energy). Furthermore, the coolant circulation, although bypassing the radiator, in all cases causes a (minimum, yet not null) cooling of the internal combustion engine, which thus warms up slower than potentially possible.

In order to solve such a drawback, it has been suggested to use a circulation pump of the cooling system controlled by a dedicated electric motor, and thus entirely independent from the crankshaft in mechanical terms; in this manner, the electrically operated circulation pump may be operated only when necessary. However, particularly in high performance internal combustion engines, the circulation pump may require considerable power (particularly when the external temperature is hot and high power delivery is required, like when driving on a race track in summer) which would require the installation of a very high performance (and thus heavy and large) electric motor to activate the circulation pump and of a very high performance (and thus heavy and large) electric generator to generate the electricity needed to activate the circulation pump.

U.S. Pat. No. 1,665,765 and Japanese Patent Application No. 2003027942 describe an internal combustion engine having: a cooling system provided with a circulation pump, an auxiliary shaft which transmits the rotation movement to a circulation pump shaft, a mechanical transmission which transmits the rotation movement of the crankshaft to the auxiliary shaft, and a coupling device which is interposed between the circulation pump and the auxiliary shaft and is suited to mechanically connect/disconnect the pump shaft to/from the auxiliary shaft. However, such constructive solutions suggested in U.S. Pat. No. 1,665,765 and Japanese Patent Application No. 2003027942 cause an increase of the overall weight and dimensions of the internal combustion engine.

SUMMARY OF THE INVENTION

It is the object of the present invention to provide an internal combustion engine provided with a cooling pump which is free from the drawbacks described above and which is easy and cost-effective to make at the same time.

According to the present invention an internal combustion engine provided with a cooling pump is provided as disclosed in the accompanying claims.

BRIEF DESCRIPTION OF THE DRAWINGS

The present invention will now be described with reference to the accompanying drawings, which illustrate some non-limitative embodiments thereof, in which.

PREFERRED EMBODIMENTS OF THE INVENTION

Figure 1:
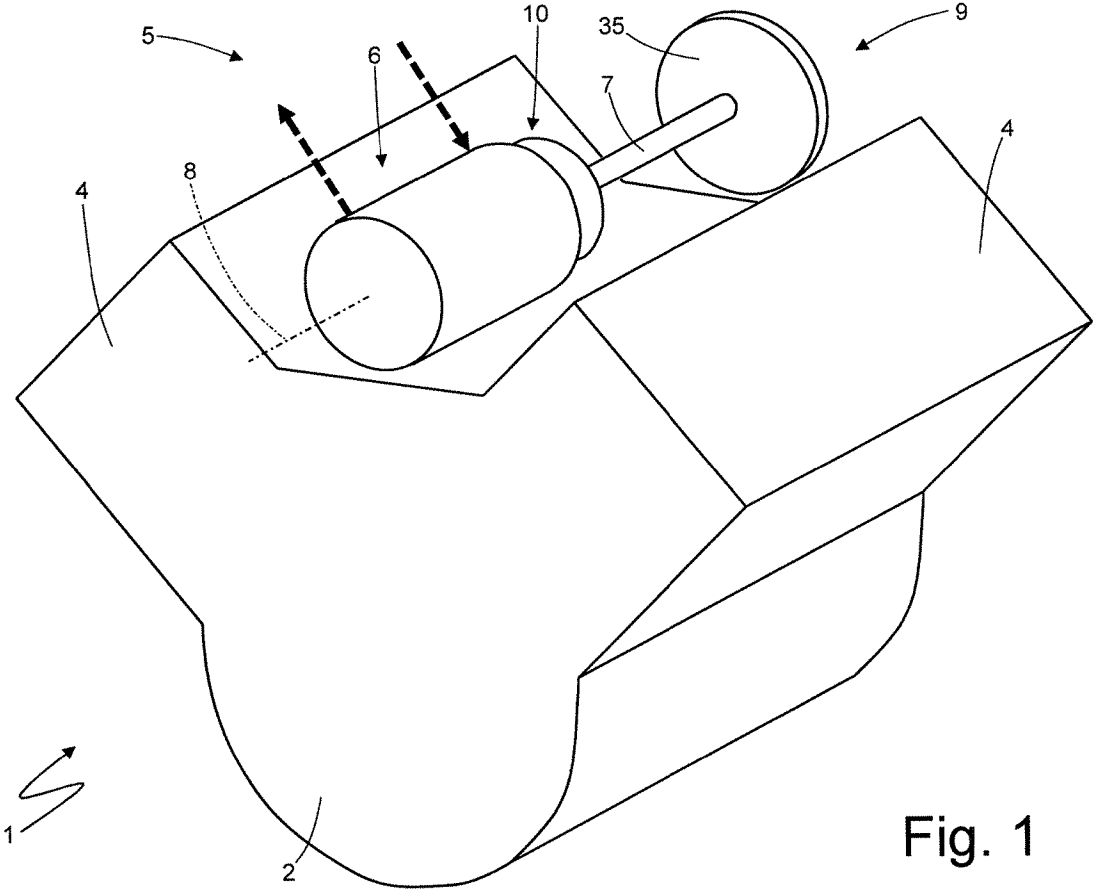
FIG. 1 is a diagrammatic, perspective view of an internal combustion engine made according to the present invention.

In FIG. 1, reference numeral 1 indicates an internal combustion engine as a whole.

The internal combustion engine 1 comprises a crankcase 2 which houses a crankshaft 3 (diagrammatically shown in FIGS. 6 and 7) and two heads 4, which house the cylinders and are arranged in a "V" with a 90° angle between the heads.

The internal combustion engine 1 comprises a cooling system 5 (diagrammatically shown) for cooling the internal combustion engine 1, which comprises a hydraulic circuit in which a coolant (typically consisting of water mixed with an antifreeze additive) flows. The cooling system 5 comprises a circulation pump of the centrifuge type for circulating the coolant along the hydraulic circuit.

The internal combustion engine 1 comprises an auxiliary shaft 7, which is mounted so as to rotate about a rotation axis 8 and transmits the rotational movement to the circulation pump 6. According to a preferred embodiment, the auxiliary shaft 7 is parallel to the crankshaft 3 and receives movement directly from the crankshaft 3 by means of a mechanical belt (or according to a technical equivalent, a chain) transmission; i.e. the mechanical belt transmission 9 transmits the rotational movement from the crankshaft 3 to the auxiliary shaft 7. The internal combustion engine also comprises a coupling device 10 which is interposed between the circulation pump 6 and the auxiliary shaft 7 and is suited to mechanically connect/disconnect the circulation pump 6 to/from the auxiliary shaft 7.

According to a preferred embodiment, shown in FIG. 1, the auxiliary shaft 7 (together with the circulation pump 6 and the coupling device 10) is arranged above the crankcase 2 of the thermal engine 1 and between the two heads 4, i.e. between the space delimited by the side of the two heads 4 arranged in a "V".

Figure 2:
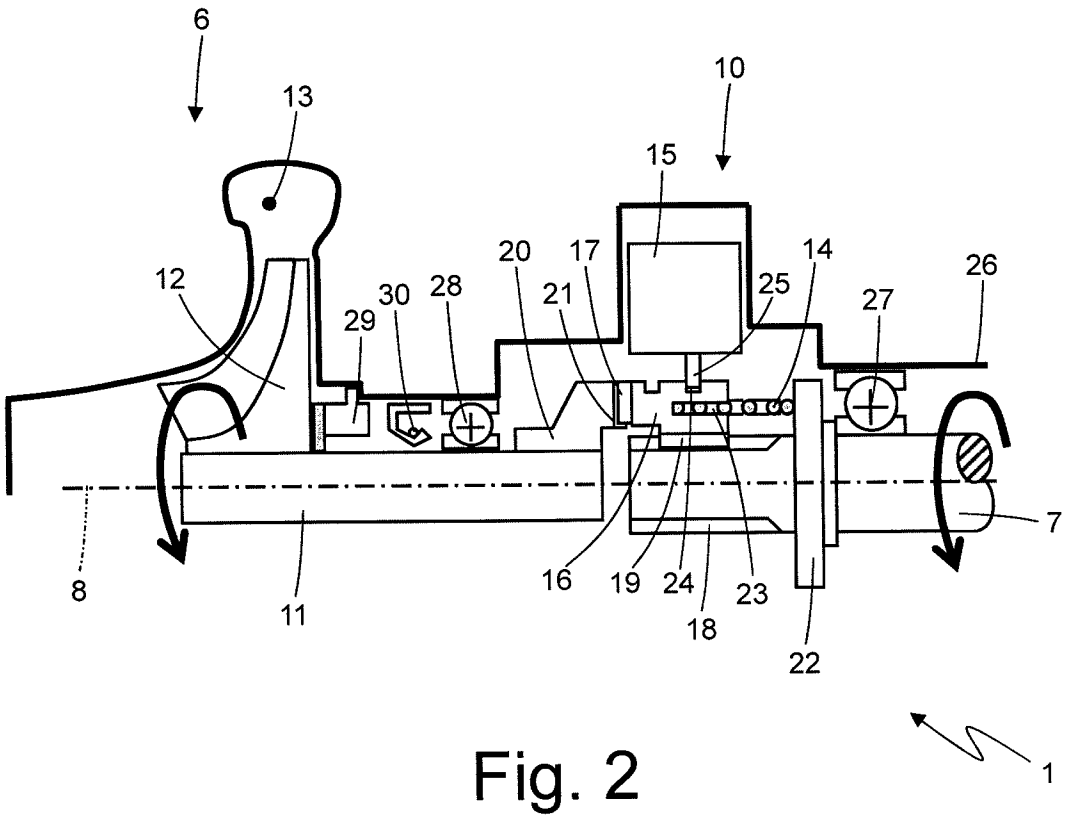
FIG. 2 is a diagrammatic, partial, axial section view of an auxiliary shaft of the internal combustion engine in FIG. 1 coupled to a circulation pump of a cooling system by means of the interposition of a coupling device.

As shown in FIG. 2, the circulation pump 6 comprises a pump shaft 11 which is mounted so as to rotate coaxially with the auxiliary shaft 7 (and is thus mounted so as to rotate about the rotation axis 9); the pump shaft 11 supports an impeller 12 which rotates within a pumping chamber 13.

The coupling device 10 comprises a spring 14, which tends to push the coupling device 10 towards a coupling position (shown in FIG. 2), in which the pump shaft 11 of the circulation pump 6 is integral with the auxiliary shaft 7. Furthermore, the coupling device 10 comprises an actuator 15, which is suited to be activated so as to move the coupling device 10, against the action of the spring 14, from the coupling position (shown in FIG. 2) to a decoupling position (shown in FIG. 3), in which the pump shaft 11 of the circulation pump 6 is disconnected from the auxiliary shaft 7. By virtue of the presence of the spring 14, the coupling device 10 is normally coupled, i.e. in the absence of control the coupling device 10 is in the coupling position (shown in FIG. 2); such a feature privileges the integrity of the internal combustion engine 1, because the operation of the circulation pump 6 is always guaranteed in case of problems to the actuator 15, and thus the cooling of the internal combustion engine 1 is guaranteed.

The actuator 15 may be of the active type, i.e. may comprise an electrically controlled actuator which may be remotely operated by an electronic control unit or may be of the passive type, i.e. may comprise a coolant temperature sensitive element (e.g. a thermostat element of the bimetallic type).

The coupling device 10 comprises a sleeve 16 which is provided with a frontal toothing 17 is mounted so as to axially slide about the auxiliary shaft 7, and is provided with axial teeth 18 which engage corresponding axial teeth 19 of the auxiliary shaft 7 to be angularly integral with the auxiliary shaft 7 and at the same time to be able to slide axially with respect to the auxiliary shaft 7 itself. Furthermore, the coupling device 10 comprises a sleeve 20 which is provided with a frontal toothing 21, is integral with the pump shaft 11 of the circulation pump 6, and is arranged in front of the sleeve 16 so that the sliding of the sleeve 16 makes the frontal toothing 17 of the sleeve 16 engage/disengage the frontal toothing 21 of the sleeve 20.

According to a preferred embodiment, the spring 14 is compressed between the sleeve 16 and an annular abutment 22 integral with the auxiliary shaft 7. Furthermore, the sleeve 16 has an axially oriented annular groove 23 in which an end of the spring 14 is inserted. The sleeve 16 has a circumferentially oriented annular groove 24 which is engaged by a finger 25 of the actuator 15 which transmits the movement generated by the actuator 15 itself to the sleeve 16.

According to a preferred embodiment, a single common containing casing (box) 26 within which the circulation pump 6 and the coupling device 10 are housed is provided. There is (at least) one bearing 27 interposed between the containing casing 26 and the auxiliary shaft 7, while there is (at least) one bearing 28 interposed between the containing casing 26 and the pump shaft 11 of the circulation pump 6. According to a preferred embodiment, the coupling device 10 is in an oil bath (i.e. is submerged in oil) to allow the continual lubrication of the sleeves 16 and 20 and the bearings 27 and 28. A gland 29 is interposed between the coupling device 10 and the circulation pump 6 and near the circulation pump 6 to contain the water within the pumping chamber 13, i.e. to prevent the leakage of water outside the circulation pump 6; furthermore, a sealing ring 30 is arranged between the coupling device 10 and the circulation pump 6 and near the coupling device 10 to contain the oil within the coupling device 10, i.e. to prevent the leakage of oil outside the coupling device 10. According to a preferred embodiment, the containing casing 26 comprises a leakage discharge channel (not shown) which originates from a "dry" annular zone comprised between the gland 29 on one side and the sealing ring 30 on the other side.

Figure 3:
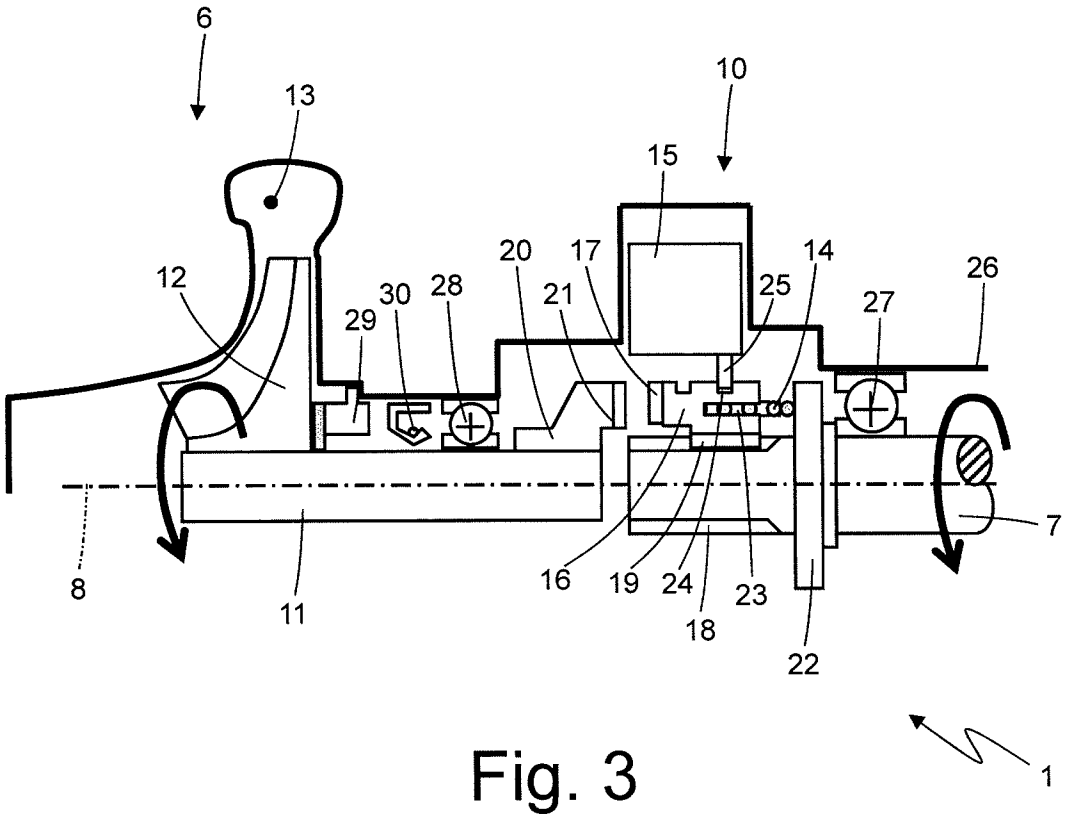
FIG. 3 is a diagrammatic, partial and axial section view of the auxiliary shaft in FIG. 2 in which the coupling device is arranged in a decoupling position different from the coupling position shown in FIG. 2.

In the embodiment shown in FIGS. 1, 2 and 3, the pump shaft 11 of the circulation pump 6 is arranged by the side of the auxiliary shaft 7; in other words, the auxiliary shaft 7 ends at the assembly formed by the circulation pump 6 and the coupling device 10.

Figure 4:
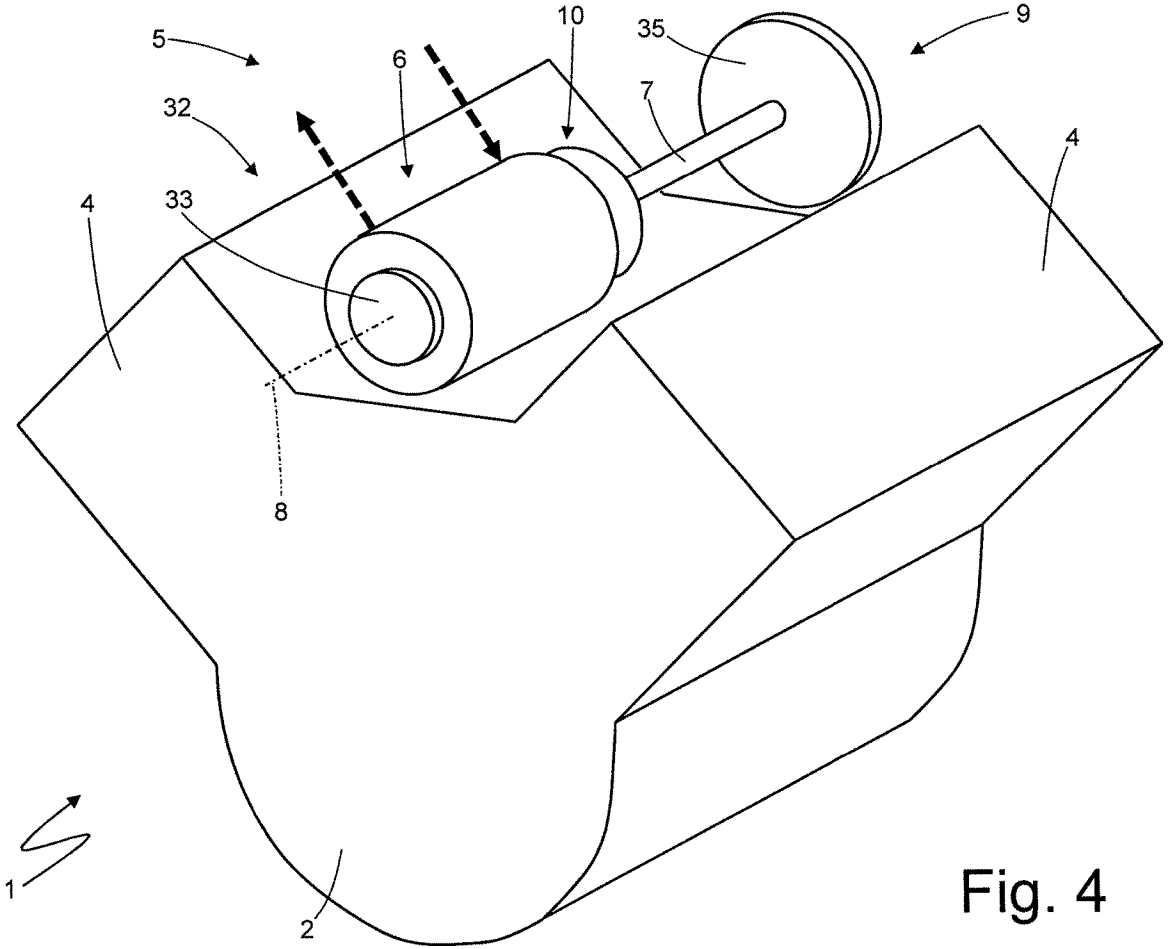
FIG. 4 is a diagrammatic, perspective view of a variant of the internal combustion engine in FIG. 1.
Figure 5:
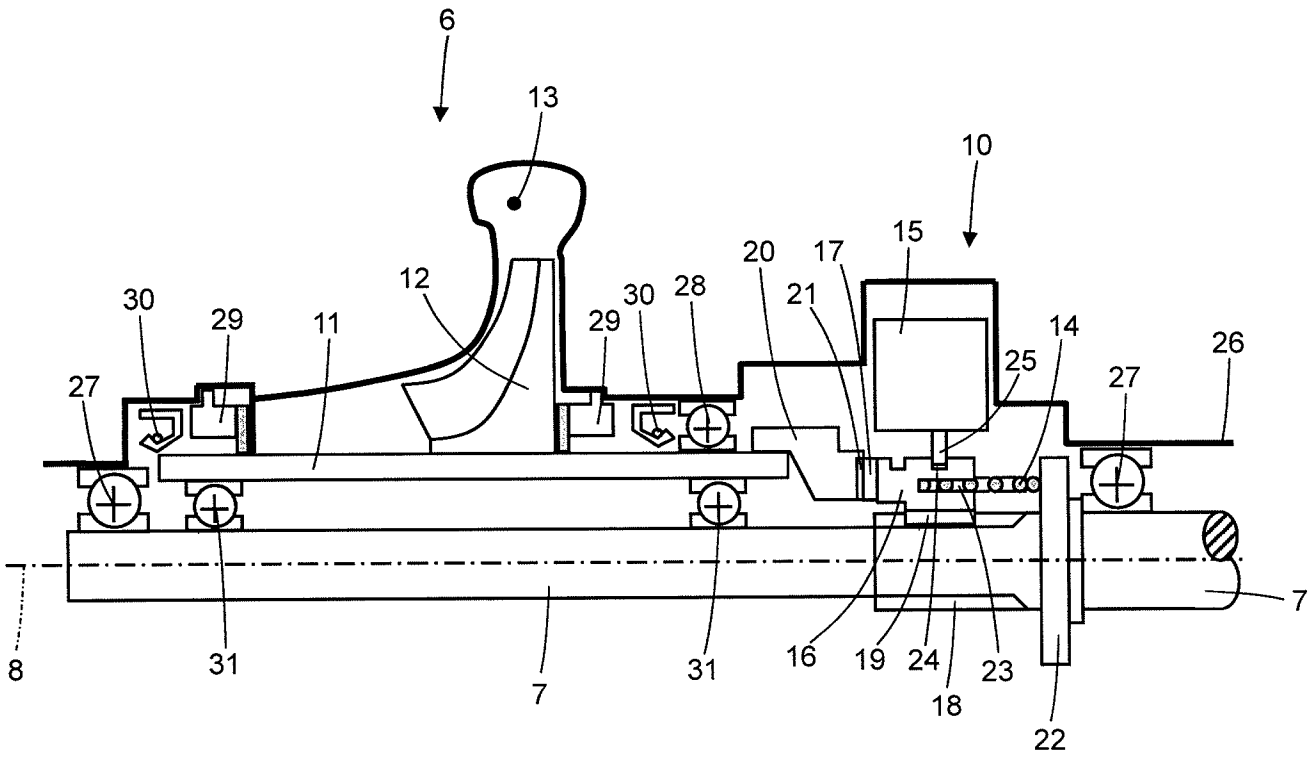
FIG. 5 is a diagrammatic, partial, axial section view of an auxiliary shaft of the internal combustion engine in FIG. 4 coupled to a circulation pump of a cooling system by means of the interposition of a coupling device.

In the embodiment shown in FIGS. 4 and 5, the pump shaft 11 of the circulation pump 6 is hollow inside and arranged about the auxiliary shaft 7, which passes through the pump shaft 11 itself; in other words, the auxiliary shaft 7 passes through the assembly formed by the circulation pump 6 and the coupling device 10 within the pump shaft 11 of the circulation pump 6. As shown in FIG. 5, in this embodiment a pair of bearings 31 are interposed between the pump shaft 11 of the circulation pump 6 and the auxiliary shaft 7 to allow a relative rotation between the pump shaft 11 of the circulation pump 6 and the auxiliary shaft 7.

As shown in FIG. 4, on the side opposite to the mechanical transmission 9, the auxiliary shaft 7 is mechanically connected to a further belt (or according to a technical equivalent, chain) mechanical transmission 32 intended to activate at least one auxiliary device (e.g. a pump of a power steering device or a compressor of a climate control system). In other words, the auxiliary shaft 7 protrudes from one side of the internal combustion engine 1 to connect to the mechanical transmission 9 and the auxiliary shaft 7 protrudes from the side opposite to the internal combustion engine 1 to connect to the mechanical transmission 32. In this manner, the two mechanical transmissions 9 and 32 are arranged at the opposite sides of the internal combustion engine 1 and are mechanically connected to opposite ends of the auxiliary shaft 7.

As shown in FIG. 4, the mechanical transmission 32 comprises a wheel 33 (a pulley in the case of a belt transmission or a toothed wheel in the case of the chain transmission) which is rigidly fixed to an end of the auxiliary shaft 7 and is engaged by a belt or by a chain (not shown) which activates the auxiliary device (not shown).

Figure 6:
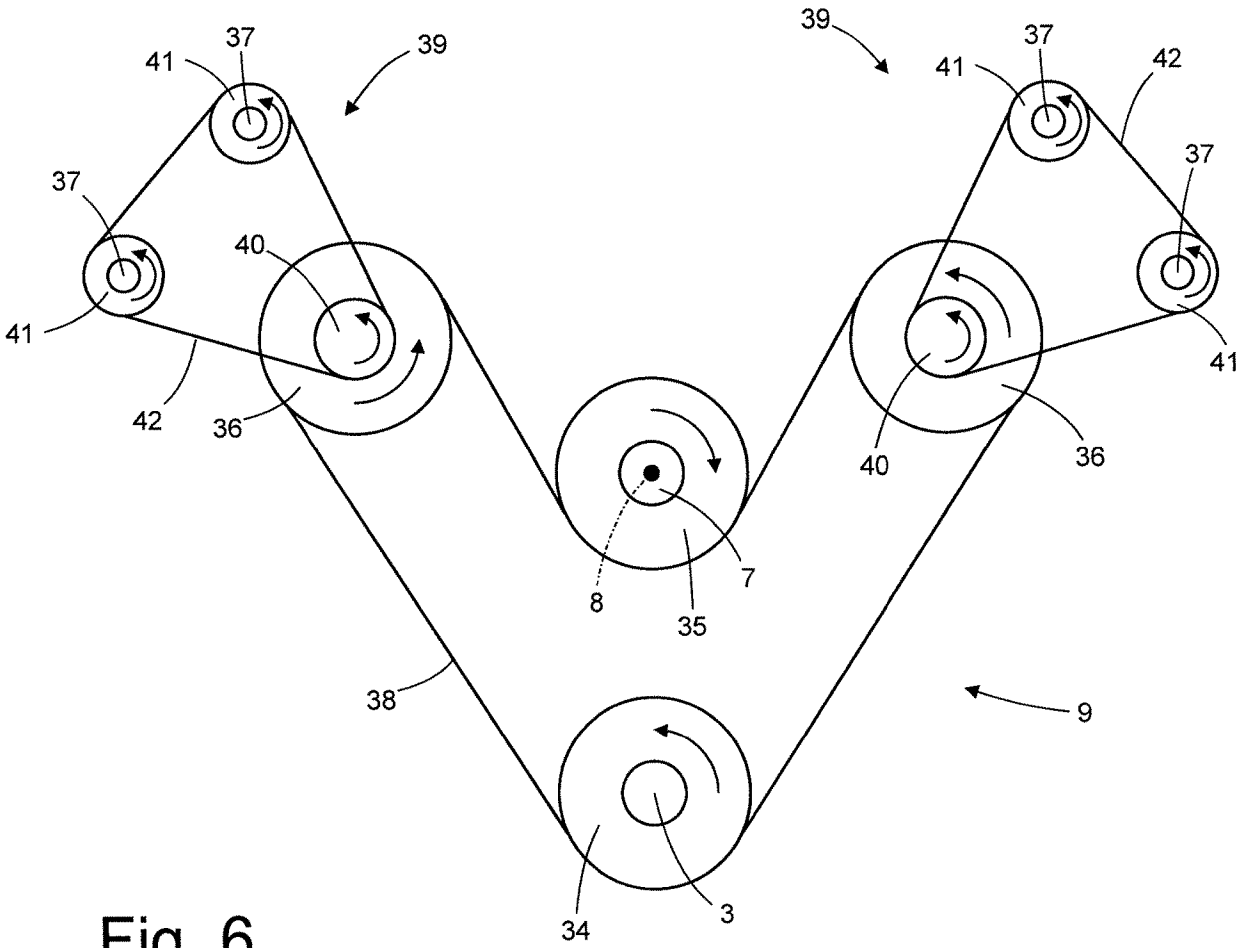
FIG. 6 is a diagrammatic, front view of a mechanical transmission of the internal combustion engine in FIG. 1 which activates the auxiliary shaft in FIG. 2.
Figure 7:
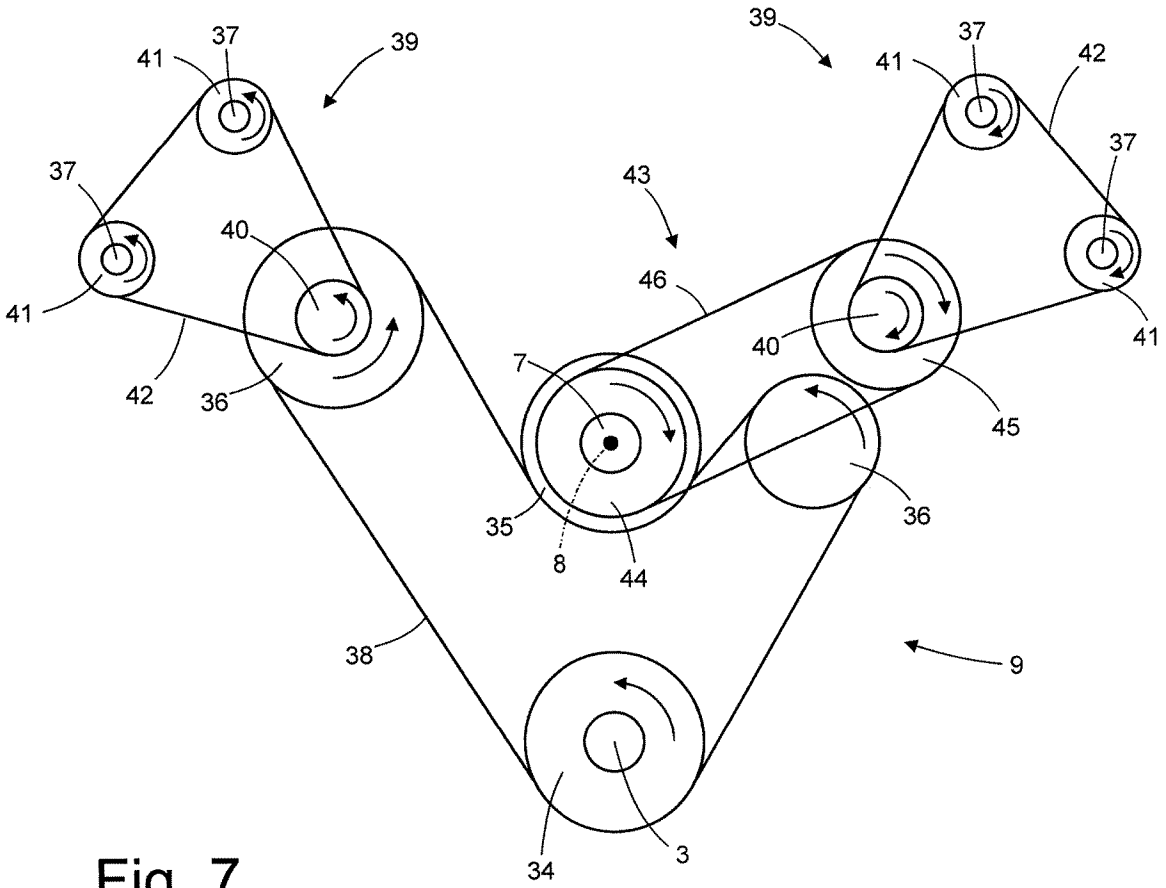
FIG. 7 is a variant of the mechanical transmission in FIG. 6.

As shown in FIG. 6, the mechanical transmission 9 comprises a wheel 34 (a pulley in the case of a belt transmission or a toothed wheel in the case of a chain transmission) which is rigidly fixed to the crankshaft 3, a wheel 35 (a pulley in the case of a belt transmission or a toothed wheel in the case of a chain transmission) which is rigidly fixed to an end of the auxiliary shaft 7, and two further wheels 36 (pulleys in the case of a belt transmission or toothed wheels in the case of a chain transmission) for controlling the timing of the internal combustion engine 1, i.e. for rotating the camshafts 37 which activate the intake and exhaust valves of the internal combustion engine 1. In other words, the mechanical transmission 9 constitutes the first demultiplication of the rotation of the crankshaft 3 towards the camshafts 37. Furthermore, the mechanical transmission 9 comprises a flexible transmission element 38 (a belt in the case of a belt transmission or a chain in the case of a chain transmission) which is closed in a ring shape and wound about the wheels 34, 35 and 36 and makes the wheels 34, 35 and 36 integral with each other.

Each head 4 of the internal combustion engine 1 comprises a corresponding mechanical transmission 39 which receives movement from the crankshaft 3 by means of the mechanical transmission 9 and activates the two camshafts 37. Each mechanical transmission 39 comprises a wheel 40 (a pulley in the case of a belt transmission or a toothed wheel in the case of a chain transmission) which is integral with a corresponding wheel 36 and two wheels 41 (pulleys in the case of a belt transmission or toothed wheels in the case of a chain transmission), each of which is integral with a corresponding camshaft 37. Furthermore, each mechanical transmission 39 comprises a flexible transmission element 42 (a belt in the case of a belt transmission or a chain in the case of a chain transmission) which is closed in a ring shape and wound about the wheels 40 and 41 and makes the wheels 40 and 41 integral with each other.

In the embodiment shown in FIG. 6, the mechanical transmission 9 directly activates both mechanical transmissions 39 of the two heads 4 and consequently, all the camshafts 37 rotate in the same direction; such a solution has some drawbacks because the tappets of one head 4 are inevitably more stressed and thus subjected to greater mechanical wear than the tappets of the other head 4. In order to avoid stressing the tappets of one head 4 more, the embodiment shown in FIG. 7 may be used in which the mechanical transmission 9 directly activates a single mechanical transmission 39, while it indirectly activates the other mechanical transmission (i.e. by means of the interposition of a further mechanical transmission 43); by virtue of the presence of the further mechanical transmission 43, the direction of rotation of the mechanical transmission 39, which is coupled to the further mechanical transmission 43, is reversed and thus the camshafts 37 of one head 4 rotate in the opposite direction to the camshafts 37 of the other head 4. In this manner, the two heads 4 are perfectly symmetric and thus the tappets of the two heads 4 are mechanically stressed exactly in the same manner.

The further mechanical transmission 43 comprises a wheel 44 (a pulley in the case of a belt transmission or a toothed wheel in the case of a chain transmission) which is integral with the wheel 35 of the mechanical transmission 9 and a wheel 45 (a pulley in the case of a belt transmission or a toothed wheel in the case of a chain transmission) which is integral with the wheel 40 of the corresponding mechanical transmission 39. Furthermore, the further mechanical transmission 43 comprises a flexible transmission element 46 (a belt in the case of a belt transmission or a chain in the case of a chain transmission) which is closed in a ring shape and wound about the wheels 44 and 45 and makes the wheels 44 and 45 integral with each other. In this embodiment, the wheel 36 of the mechanical transmission 9 arranged near the further mechanical transmission 43 is mechanically disconnected from the other elements (obviously except for the flexible transmission element 38 of the mechanical transmission 9) and performs the sole function of flexible transmission element 38 of the mechanical transmission 9.

It is worth noting that the auxiliary shaft 7 is arranged in central position and rotates in direction opposite to the crankshaft 3 (i.e. is counter-rotating), thus the auxiliary shaft 7 may be unbalanced (i.e. provided with eccentric masses) to balance the internal combustion engine 1 (i.e. to compensate the vibrations generated by the operation of the internal combustion engine 1 at least in part). Obviously, by appropriately dimensioning the wheels 34 and 35 of the mechanical transmission 9 it is possible to obtain the desired ratio between the angular speed crankshaft 3 and the angular speed of the auxiliary shaft 7 in order to optimize the balancing operated by the auxiliary shaft 7; in particular, the two wheels 34 and 35 may have the same diameter to impart the same angular speed as the crankshaft 3 to the auxiliary shaft 7 and thus balance the first order moments; alternatively, the diameter of the wheel 35 may be half the diameter of the wheel 34 to impart an angular speed which is double the angular speed of the crankshaft 3 to the auxiliary shaft 7 and thus balance the second order moments. It is worth noting that using the auxiliary shaft 7 of the mechanical transmission 9 as "balancing countershaft" has the advantage of using the same component (the auxiliary shaft 7) for two different functions with an obvious optimization which allows to reduce weight and dimensions.

According to a different embodiment, the auxiliary shaft 7 could not be used as "balancing countershaft"; in this case, the auxiliary shaft 7 could be made to rotate in the same direction as the crankshaft 3.

In the embodiment shown in FIGS. 4 and 5, the unbalance of the auxiliary shaft 7 is particularly favorable because it may be obtained by inserting eccentric masses in the two wheels 32 and 35 on the opposite ends of the auxiliary shaft 7 instead of directly in the auxiliary shaft 7: indeed, the diameter of the two wheels 32 and 35 is greater than the diameter of the auxiliary shaft 7 and thus arranging an eccentric weight on the periphery of a wheel 32 or 35 confers a very long arm to the eccentric mass with respect to the rotation axis 8; in this manner, a very small eccentric mass is sufficient, the moment of inertia being the same.

According to a further embodiment not shown, the auxiliary shaft 7 solely performs the function of balancing countershaft and thus is used to activate neither the circulation pump 6 nor other auxiliary devices; alternatively, the auxiliary shaft 7 activates other auxiliary devices by means of the mechanical transmission 32 but does not activate the circulation pump 6.

The internal combustion engine 1 described above has many advantages.

Firstly, the internal combustion engine 1 described above allows to activate the circulation pump 6 of the cooling system 5 only when actually useful/necessary (i.e. only when the internal combustion engine 1 has reached the optimal working temperature).

Furthermore, in the internal combustion engine 1 described above the actuation of the circulation pump 6 of the cooling system 5 is always of the mechanical type and torque is derived directly from the crankshaft 3; in this manner, the actuation of the circulation pump 6 is much more energy-efficient and the electric system does not need to be overdimensioned.

In the internal combustion engine 1 described above the actuation of the circulation pump 6 of the cooling system 5 is always guaranteed because the coupling device 10 is normally coupled; i.e. in case of malfunctioning of the actuator 15 of the coupling device 10, the coupling device 10, by virtue of the action of the spring 14, always maintains the coupling device 10 in the coupled position.

In the internal combustion engine 1 described above, the auxiliary shaft 7 may also be used as balancing countershaft with obvious optimization of weight and dimensions.

In the internal combustion engine 1 described above, in particular in the embodiment shown in FIGS. 4 and 5, the auxiliary devices may be moved onto the other side of the internal combustion engine 1 with respect to the side from which the crankshaft 3 protrudes, thus freeing up space that may be exploited, for example, to house the mechanical components needed to obtain a selectable four-wheel drive.

Finally, in the internal combustion engine 1 described above, the mechanical transmission 9 is not only used to activate the auxiliary shaft 7 but also to activate the timing (i.e. to rotate the camshafts 37) with obvious optimization of weight and dimensions.

What is claimed is:

1. An internal combustion engine comprising:

a crankshaft;

a cooling system provided with a circulation pump, which comprises an impeller supported by a pump shaft that is mounted so as to rotate around a rotation axis;

an auxiliary shaft, which transmits a rotation movement to the pump shaft of the circulation pump;

a first mechanical transmission, which transmits the rotational movement from the crankshaft to the auxiliary shaft; and a coupling device, which is interposed between the pump shaft of the circulation pump and the auxiliary shaft and is suited to mechanically connect/disconnect the pump shaft to/from the auxiliary shaft;

wherein the auxiliary shaft rotates in an opposite direction with respect to the crankshaft and is unbalanced so as to act as balancing countershaft;

wherein the coupling device comprises: a spring, which tends to push the coupling device towards a coupling position, in which the pump shaft of the circulation pump is integral to the auxiliary shaft; and an actuator, which is suited to be activated so as to move the coupling device, against the action of the spring, from the coupling position to a decoupling position, in which the pump shaft of the circulation pump is disconnected from the auxiliary shaft;

wherein the internal combustion engine comprises control means for activating the actuator of the coupling device for moving the coupling device from the coupling position to the decoupling position when the internal combustion engine has not reached an optimal working temperature; and wherein the coupling device comprises:

a first sleeve, provided with a first frontal toothing mounted so as to axially slide around the auxiliary shaft, the first sleeve also being provided with axial teeth which engage corresponding axial teeth of the auxiliary shaft, so as to be angularly integral to the auxiliary shaft; and a second sleeve, provided with a second frontal toothing integral to the pump shaft of the circulation pump, the second sleeve being arranged in front of the first sleeve, so that the sliding movement of the first sleeve causes the first frontal toothing of the first sleeve to engage/disengage the second frontal toothing of the second sleeve.

2. An internal combustion engine according to claim 1, wherein the spring is compressed between the first sleeve and an annular abutment, which is integral to the auxiliary shaft.

3. An internal combustion engine according to claim 2, wherein the first sleeve has an annular groove, into which an end of the spring is inserted.

4. An internal combustion engine according to claim 1, wherein the pump shaft of the circulation pump is internally hollow and is arranged around the auxiliary shaft, which extends through the pump shaft itself.

5. An internal combustion engine according to claim 4, wherein a pair of bearings is interposed between the pump shaft of the circulation pump and the auxiliary shaft.

6. An internal combustion engine according to claim 1 and comprising a single common containing casing, which houses the circulation pump and the coupling device; the coupling device is in an oil bath and between the coupling device and the circulation pump there are interposed a gland.

7. An internal combustion engine according to claim 6, wherein the containing casing comprises a leakage discharge channel, which originates from an annular area comprised between the gland on one side and the sealing ring on the other side.

8. An internal combustion engine according to claim 1 and comprising a crankcase, which houses the crankshaft and two heads, which house cylinders and are arranged in a "V" shape; the auxiliary shaft and the circulation pump are arranged between the two heads.

9. An internal combustion engine according to claim 8 and comprising a second mechanical transmission, which is arranged on the opposite side of the internal combustion engine with respect to the first mechanical transmission, receives the rotation movement from the auxiliary shaft, and activates at least one auxiliary device.

10. An internal combustion engine according to claim 8, wherein the first mechanical transmission controls a timing by causing the rotation of camshafts that activate intake and exhaust valves.

11. An internal combustion engine according to claim 10, wherein the first mechanical transmission comprises:

a first wheel, which is rigidly fixed to the crankshaft;

a second wheel, which is rigidly fixed to the auxiliary shaft;

two third wheels, each of which is coupled to a corresponding head of said two heads and transmits the movement to corresponding camshafts of said camshafts; and a first flexible transmission element, which is closed in a ring shape and is wound around the first wheel, the second wheel and the third wheels.

12. An internal combustion engine according to claim 11, wherein each head comprises a corresponding second mechanical transmission, which receives the rotation movement from a corresponding one of the third wheels of the first mechanical transmission and causes the rotation of at least one respective camshaft of said camshafts.

13. An internal combustion engine according to claim 8, wherein the first mechanical transmission comprises:

a first wheel, which is rigidly fixed to the crankshaft;

a second wheel, which is rigidly fixed to the auxiliary shaft;

a third wheel, which is coupled to a first head and transmits the movement to corresponding camshafts of the first head;

a first flexible transmission element, which is closed in a ring shape and is wound around the first wheel, the second wheel and the third wheel; and a third mechanical transmission, which receives the motion from the second wheel and transmits the movement to corresponding camshafts of a second head.

14. An internal combustion engine according to claim 13, wherein each head comprises a corresponding second mechanical transmission, which receives the rotation movement from the third wheel of the first mechanical transmission or from the third mechanical transmission and causes the rotation of corresponding camshafts.

15. An internal combustion engine comprising:

a crankshaft;

a cooling system provided with a circulation pump, which comprises an impeller supported by a pump shaft that is mounted so as to rotate around a rotation axis;

an auxiliary shaft, which transmits a rotation movement to the pump shaft of the circulation pump; a first mechanical transmission, which transmits the rotational movement from the crankshaft to the auxiliary shaft; and a coupling device, which is interposed between the pump shaft of the circulation pump and the auxiliary shaft and is suited to mechanically connect/disconnect the pump shaft to/from the auxiliary shaft;

wherein the internal combustion engine comprises a crankcase which houses the crankshaft and two heads, which house the cylinders and are arranged in a "V"; the auxiliary shaft and the circulation pump are arranged over the crankcase between the two heads;

wherein the coupling device comprises: a spring, which tends to push the coupling device towards a coupling position, in which the pump shaft of the circulation pump is integral to the auxiliary shaft; and an actuator, which is suited to be activated so as to move the coupling device, against the action of the spring, from the coupling position to a decoupling position, in which the pump shaft of the circulation pump is disconnected from the auxiliary shaft;

wherein the internal combustion engine comprises control means for activating the actuator of the coupling device for moving the coupling device from the coupling position to the decoupling position when the internal combustion engine has not reached an optimal working temperature;

wherein the pump shaft of the circulation pump is internally hollow and is arranged around the auxiliary shaft, which extends through the pump shaft; and wherein a pair of bearings is interposed between the pump shaft of the circulation pump and the auxiliary shaft.

16. An internal combustion engine comprising:

a crankshaft;

a cooling system provided with a circulation pump, which comprises an impeller supported by a pump shaft that is mounted so as to rotate around a rotation axis;

an auxiliary shaft, which transmits a rotation movement to the pump shaft of the circulation pump;

a first mechanical transmission, which transmits the rotational movement from the crankshaft to the auxiliary shaft; and a coupling device, which is interposed between the pump shaft of the circulation pump and the auxiliary shaft and is suited to mechanically connect/disconnect the pump shaft to/from the auxiliary shaft;

wherein the auxiliary shaft rotates in an opposite direction with respect to the crankshaft and is unbalanced so as to act as a balancing countershaft;

wherein the pump shaft of the circulation pump is internally hollow and is arranged around the auxiliary shaft, which extends through the pump shaft; and wherein a pair of bearings is interposed between the pump shaft of the circulation pump and the auxiliary shaft.

17. An internal combustion engine according to claim 16 and comprising a single common containing casing, which houses the circulation pump and the coupling device; the coupling device is in an oil bath and between the coupling device and the circulation pump there are interposed a gland.

18. An internal combustion engine according to claim 17, wherein the containing casing comprises a leakage discharge channel, which originates from an annular area comprised between the gland on one side and the sealing ring on the other side.

19. An internal combustion engine according to claim 16 and comprising a crankcase, which houses the crankshaft and two heads, which house cylinders and are arranged in a "V" shape; the auxiliary shaft and the circulation pump are arranged between the two heads.

20. An internal combustion engine according to claim 19, wherein the first mechanical transmission controls a timing by causing the rotation of camshafts that activate intake and exhaust valves.

21. An internal combustion engine according to claim 20, wherein the first mechanical transmission comprises:

a first wheel, which is rigidly fixed to the crankshaft;

a second wheel, which is rigidly fixed to the auxiliary shaft;

two third wheels, each of which is coupled to a corresponding head of said two heads and transmits the movement to corresponding camshafts of said camshafts; and a first flexible transmission element, which is closed in a ring shape and is wound around the first wheel, the second wheel and the third wheels.

22. An internal combustion engine according to claim 21, wherein each head comprises a corresponding second mechanical transmission, which receives the rotation movement from a corresponding one of the third wheels of the first mechanical transmission and causes the rotation of at least one respective camshaft of said camshafts.

23. An internal combustion engine according to claim 19, wherein the first mechanical transmission comprises:

a first wheel, which is rigidly fixed to the crankshaft;

a second wheel, which is rigidly fixed to the auxiliary shaft;

a third wheel, which is coupled to a first head and transmits the movement to corresponding camshafts of the first head;

a first flexible transmission element, which is closed in a ring shape and is wound around the first wheel, the second wheel and the third wheel; and a third mechanical transmission, which receives the motion from the second wheel and transmits the movement to corresponding camshafts of a second head.

24. An internal combustion engine according to claim 23, wherein each head comprises a corresponding second mechanical transmission, which receives the rotation movement from the third wheel of the first mechanical transmission or from the third mechanical transmission and causes the rotation of corresponding camshafts.

* * * * *